US005282348A

United States Patent [19]

Dampier et al.

[11] Patent Number: 5,282,348

[45] Date of Patent: Feb. 1, 1994

[54] CLIP-TYPE ARTICLE CARRIER AND METHOD OF MANUFACTURE

[75] Inventors: Clayton Dampier, Marietta; Octavio Orta, Atlanta, both of Ga.

[73] Assignee: Riverwood International Corporation, Atlanta, Ga.

[21] Appl. No.: 899,192

[22] Filed: Jun. 16, 1992

[51] Int. Cl.[5] ..... B65B 21/06; B65B 27/04

[52] U.S. Cl. ..... 53/398; 53/413; 53/48.1

[58] Field of Search ..... 53/398, 413, 447, 449, 53/48.1, 448, 48.6, 48.7, 48.8, 134.1

[56] References Cited

U.S. PATENT DOCUMENTS

| | | | |
|---|---|---|---|
| 2,320,440 | 6/1943 | Kruea et al. | 224/15 |
| 2,737,326 | 3/1956 | Toensmeier | 224/45 |
| 2,965,410 | 12/1960 | Hughes | 294/87.2 |
| 3,046,711 | 7/1962 | Harrison | 53/398 |
| 3,245,711 | 4/1966 | Dantoin | 294/87.2 |
| 3,310,334 | 3/1967 | Murphy | 294/87.28 |
| 3,404,912 | 10/1968 | Watts | 294/87.2 |
| 3,432,202 | 3/1969 | Ebelhardt | 294/87.2 |
| 3,653,503 | 4/1972 | Arneson | 206/65 C |
| 3,660,961 | 5/1972 | Ganz | 53/48.6 |
| 3,674,136 | 7/1972 | Forrer | 206/65 S |
| 3,742,677 | 7/1973 | Best | 53/398 |
| 3,860,281 | 1/1975 | Wood | 294/87.2 |
| 3,897,873 | 8/1975 | Graser | 206/153 |
| 4,036,362 | 7/1977 | Ullman | 53/447 X |
| 4,121,401 | 10/1978 | Duerr et al. | 53/398 |
| 5,065,565 | 11/1991 | DiFrank | 53/398 |
| 5,099,632 | 3/1992 | Klygis et al. | 53/398 |
| 5,167,325 | 12/1992 | Sykora | 53/398 X |
| 5,168,989 | 12/1992 | Benno | 53/398 X |
| 5,174,444 | 12/1992 | Adams et al. | 53/448 X |

*Primary Examiner*—Horace M. Culver

[57] ABSTRACT

A clip-type carrier is provided with an outer wrap having a top panel overlying and adhered to the support body of the carrier. Side panels of partial or full height are connected to the top panel of the outer wrap and either end panels or a bottom panel or both connect the side panels. Other package variations are formed by wrapping a plurality of carrier units together, including packages formed by wrapping stacked carrier units. The basic carrier unit may be formed in a first module or packaging station from which the units are sent by conveyor to one of a plurality of other wrapping modules, depending on the style of package desired.

10 Claims, 6 Drawing Sheets

FIG. 3
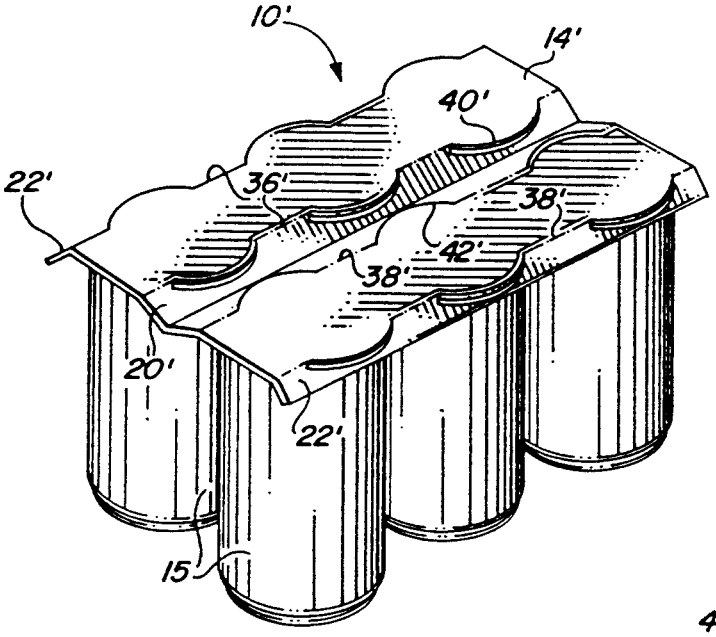
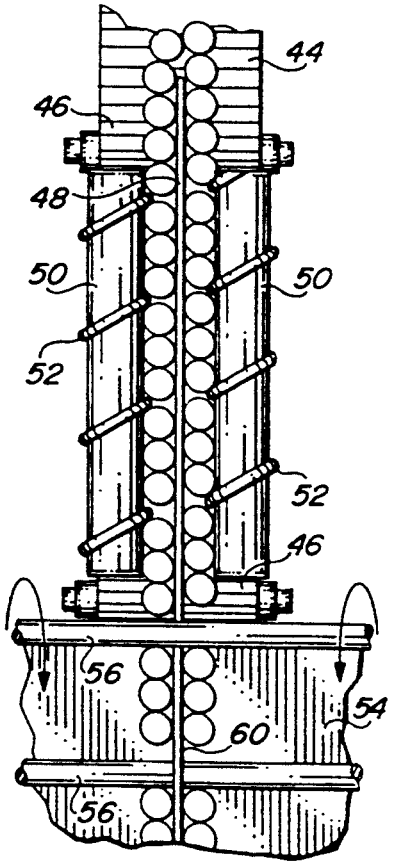
FIG. 4
FIG. 6
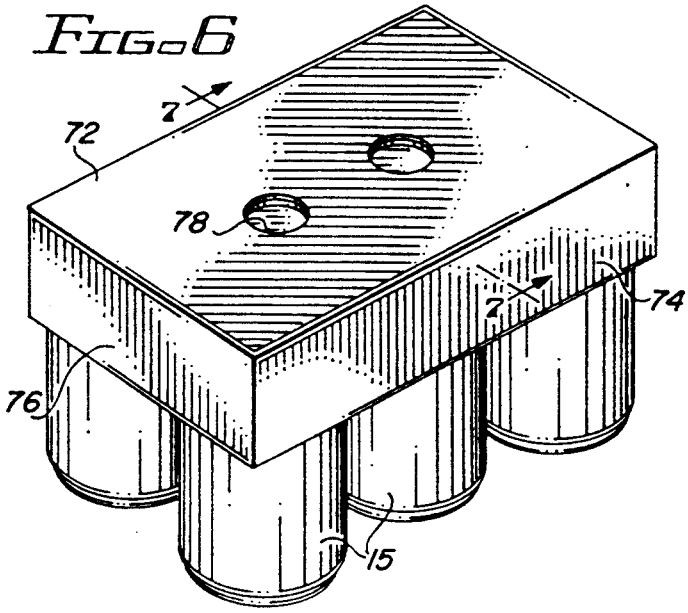

CLIP-TYPE ARTICLE CARRIER AND METHOD OF MANUFACTURE

FIELD OF THE INVENTION

This invention relates to article carriers of the type that support articles from an upper flange when the carrier is lifted. More particularly, it relates to an improved form of such a carrier and to a method of manufacture.

BACKGROUND OF THE INVENTION

Carriers that grip the upper portions of articles to enable the articles to be lifted and carried are well known, particularly in connection with beverage cans. For example, plastic carriers which contain openings that fit over the tops of beverage cans so as to grip the cans in the area just below the can chimes are common. Although economical to produce, such clip-type carriers have a number of drawbacks. Because the plastic material is not biodegradable, the carriers are viewed as contributing to environmental problems. The thin plastic material which enables the carrier to be forced over the tops of the cans limits the weight of the package and can be painful to a person's fingers when the package is carried by the usual finger holes for any length of time. Further, such carriers provide no space for printed advertising material or other indicia.

Paperboard carriers have been designed for carrying beverage containers in similar fashion, that is, by supporting the top portions of containers so that the suspended containers beneath that point are unenclosed. One such design for carrying beverage cans utilizes a panel containing apertures through which the tops of the cans extend. The cans are held in place by adjacent support edges which engage the underside of the can chimes. Although paperboard carriers of this type provide certain advantages, such as being more comfortable to carry and being more environmentally acceptable, they provide no space other than the clip itself for advertising or other indicia and are not considered suitable for packaging all beverages. Certain premium beverages, for example, require packages that are more traditional in appearance, often being required to fully enclose the beverage containers despite the fact that such packages are more costly due to the amount of paperboard required to produce them. It would be highly desirable to be able to employ a clip-type carrier that does not suffer from these drawbacks.

Another problem in packaging articles, particularly beverage containers, is the high cost of changing from one type of carrier to another, which normally requires shutting down the operation of the packaging machine being used and starting up another machine. As a result, expensive packaging machines designed to produce a particular form of package often sit idle for long periods.

It would be beneficial to be able to change from one type of package to another with only minimum downtime and without requiring an investment in packaging machines which are only periodically used.

BRIEF SUMMARY OF THE INVENTION

In one aspect of the invention a carrier is provided for packaging a plurality of articles each of which has an outwardly extending flange in its upper portion. Beverage cans, with their outwardly extending chimes, and beverage bottles, with their outwardly extending lips or rims just beneath the bottle caps, are examples of such articles. A clip-type carrier, comprising an article support body including a plurality of apertures and adjacent support surfaces, is attached to the articles so that the article flanges protrude through the apertures and are supported by the support surfaces. In addition, the carrier includes an outer wrap comprising a top panel which overlies and is connected to the article support body. Opposite side panels are connected to the top panel, and at least one additional panel connects the opposite side panels.

By reason of this construction, the portion of the carrier subjected to primary lifting and carrying stresses is minimized, thereby minimizing the portion of the carrier that must be formed from relatively thick, expensive load-bearing material. This allows the added top panel and side panels to be formed from relatively thin inexpensive material. The result is a carrier that retains the more conventional appearance of enclosed or partially enclosed packages, but is more economical to manufacture. Further, because the clip-type support element is covered by the outer wrap and is therefore not exposed to view, it can be produced from relatively inexpensive material which meets the necessary structural needs without regard to esthetics. Paperboard comprised of large amounts of recycled fibers can therefore be used to form the support element inasmuch as this material need not be capable of receiving quality printing.

The carriers of the invention may take various forms by modifying the side and end panels and including a bottom panel, as discussed in more detail below. Further, they need not be limited to carriers designed to hold a set number of articles. For example, if a clip-type support member and its attached articles are considered to be a single carrier unit, a number of units may be included in the outer wrap to form a larger package.

In another aspect of the invention, different carrier designs are formed in a highly efficient manner by breaking down the packaging process into various packaging steps and providing different modules or stations for carrying out the steps. This contrasts with the common practice of providing a number of separate independent packaging machines, each of which is capable only of producing a particular type of package. Thus, instead of providing independent packaging machines each of which has its own article feeding section, only one article feeding section is required for segregating articles into groups of the desired number to be packaged together. The grouped articles are then continuously moved to a first packaging station where they are secured to the support body described above to form a carrier unit. The carrier units are then continuously moved to one of several additional modules or packaging stations designed to complete the packaging operation for the particular style of carrier being produced.

For example, one of the additional modules is designed to attach an outer carrier wrap to the article support body of a carrier unit to produce a package containing a single carrier unit. Another module is designed to attach an outer carrier wrap to the article support bodies of a plurality of adjacent carrier units in order to produce a larger carrier containing multiples of the number of articles in a carrier unit. Another module is designed to attach an outer carrier wrap to a plurality of stacked carrier units to produce a larger carrier of more uniform dimensions. In each case the wrapped units may then be moved to a further packaging station.

The features of the invention which enable it to provide the results mentioned above are brought out in more detail in the description of the preferred embodiments, wherein the above and other aspects of the invention, as well as other benefits, will readily become apparent.

BRIEF DESCRIPTION OF THE DRAWINGS

FIG. 3 is a pictorial view of another clip-type carrier unit which can be employed in the present invention;

FIG. 4 is a partial simplified plan view of an article feeding section that could be employed in the present invention;

FIG. 6 is a pictorial view of one form of carrier produced by the invention;

DETAILED DESCRIPTION OF THE PREFERRED EMBODIMENTS

Figure 1:
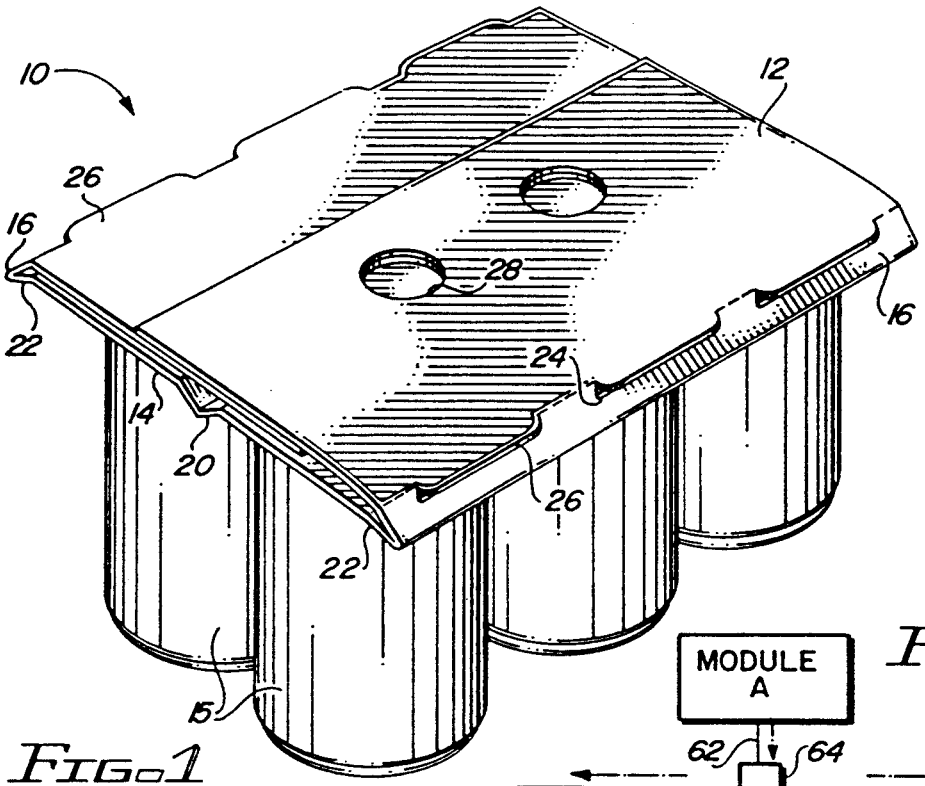
FIG. 1 is a pictorial view of a clip-type carrier unit which can be employed in the present invention.

Referring to FIG. 1, a clip-type carrier 10, referred to herein at times as a support body, is comprised of a top panel 12 foldably connected to bottom panel 14 by short side panels 16. The upper portions of cans 15 extend through openings in the bottom panel 14 and are held in place by support tabs, neither the openings nor the support tabs being visible in this view. The top panel is not as wide as the bottom panel, resulting in the side panels 16 being inwardly sloped. Reinforcing ribs 20 are provided in the bottom panel between the rows of cans, forming a groove between the ribs, and side reinforcing strips 22 are provided at the side edges of the carrier adjacent the side panels 16. The side panels contain cutouts 24 which are aligned with the rim or chime of adjacent cans and are located immediately beneath tabs 26 which extend outwardly from the top panel 12. Finger holes 28 are provided in the top panel to facilitate lifting the carrier.

Figure 2:
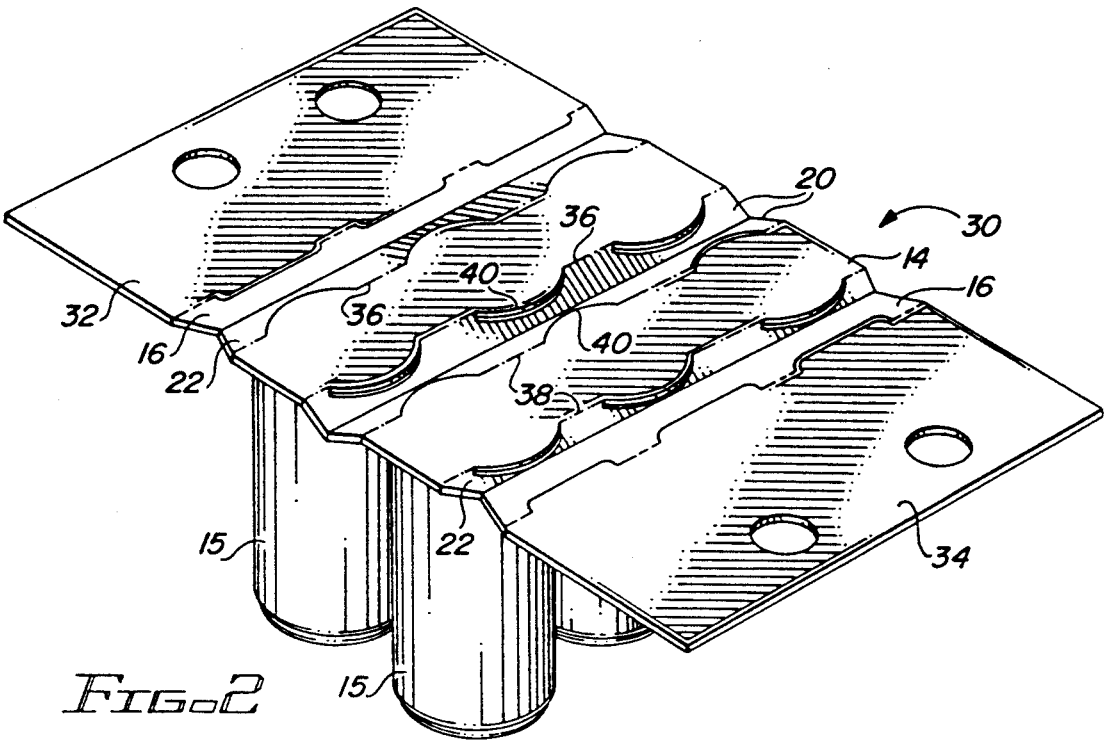
FIG. 2 is a pictorial view of the carrier of FIG. 1 shown with the top flaps open prior to being folded in to form the top panel.

The carrier 10 is formed from a generally rectangular paperboard blank 30, shown in FIG. 2 at the beginning of the carrier fabrication process. The blank includes an inner top panel flap 32 at one end and an outer top panel flap 34 at the other. Two rows of spaced fold lines 36 and in the bottom panel on either side of the rib folds 20 are interrupted by three outwardly curved slits 40 and 42, respectively.

To form the carrier 10, the blank 30 is positioned on top of the group of six adjacent cans 15 which have been arranged in two rows of three each so that the curved slits 40 and 42 are substantially aligned with opposite portions of the rims of the cans. The two rows of cans are spaced apart a short distance in order to be properly aligned with the blank. Relative movement between the bottom panel section 14 and the cans is caused by applying downward pressure to the bottom panel section. The distance between the midpoints of opposite curved slits of each pair of slits 40 and 42 is substantially equal to the diameter of the reduced diameter portion of a can just below the can chime. When relative movement of the cans and the bottom panel section occurs the can chimes are forced through the slits due to the resiliency of the paperboard until the locking edges in the reinforcing ribs 20 and reinforcing sections 22 snap back into the reduced diameter portion of the cans.

The top panel flaps are next folded up, with the outer top panel flap 34 being brought into overlapping relationship with the inner top panel flap 32 after the rows of cans have been moved toward each other to bring adjacent cans in the adjacent rows into abutting relationship. With the cans in this position the top panel flaps are moved to their final positions in which the finger holes are aligned, and the flaps are glued to the bottom panel 14 and to each other.

The carrier blank may be moved relative to the cans and the top panel flaps tightened into their final position by any suitable means. Details of apparatus for carrying out these functions are not disclosed herein since the design of such equipment is already known and is well within the scope of those skilled in the packaging art. For example, the method of assembly disclosed in U.S. Pat. No. 3,653,503 could be employed, in which blanks are deposited on top of successive groups of cans moving through the packaging machine and are forced down over the can chimes by a plowing mechanism.

The invention is not limited to the use of the carrier described since any design of clip-type carrier which is capable of supporting flanged articles may be used. For example, the carrier need not be provided with a top panel but may simply comprise a single-layer support body, such as that shown in FIG. 3, wherein the carrier panel 14' is similar to the bottom panel 14 of the support body of FIG. 1. Thus, the chimes of cans 15 extend through curved slits 40' and 42' and are supported by central ribs 20' and side reinforcing strips 22'. As in the FIG. 1 design, the central rib 20' and side reinforcing strip 22' on one side of the carrier are connected to the panel 14' by fold lines 36', while the other central rib and side reinforcing strip are connected to the panel 14' by fold lines 38'. Although this arrangement is not as strong as the FIG. 1 design, it is entirely adequate to support most carrier loadings and is more economical since the carrier requires less material. Any suitable method for attaching articles to the carrier may be employed, such as the method referred to above, without, of course, means for folding and securing top panel flaps.

Any suitable means for feeding articles into the machine in order to have two rows of segregated articles continuously moving through the clip attachment area may be employed. For illustrative purposes only, one way of accomplishing this is shown in FIG. 4, wherein articles are delivered by infeed conveyor 44 to conveyor 46, which is preferably comprised of rigid support plates connected at their ends to endless chains, not shown. Supported just above the surface of the conveyor 46 is a vertically arranged separator plate 48 which divides the incoming articles into two rows. Mounted above the outer edges of the conveyor 46 are rotating screws 50 which incorporate spiral vanes 52 configured to engage every third article in the rows to thus segregate the incoming articles into groups of three. A support surface 54 is spaced a short distance from the downstream end of the conveyor 46 to provide room for flight bars 56 to vertically run up through the space and then move in a downstream direction to push the groups of articles toward the packaging area discussed above. The groups of articles in each row are separated from each other during downstream movement by a divider strip 60 which is spaced from the support surface 54 a sufficient distance to allow room for passage of the flight bars and which has a thickness designed to align the rows of articles with the apertures in the support body blanks later deposited onto the articles.

As mentioned, one aspect of the invention is to provide modules or packaging stations at which various phases of packaging fabrication take place. Thus the feeding and grouping of the articles to be packaged and the formation of the support clip and its attachment to the upper portion of the articles may take place within the first module of the system. The first module of the system is schematically represented as module A in FIG. 5.

Although the particular support bodies or carriers of FIGS. 1, 2 and 3 have been disclosed in some detail, as mentioned above, they are merely illustrative of clip-type carriers that can be used in the present invention and should not be interpreted as limiting the various designs of carriers that can be used. It will be understood that although the carrier unit illustrated is adapted to carry six cans, the invention is also applicable to carriers designed to support fewer or more articles. Further, while the carrier unit has been described in connection with the packaging of beverage cans, it can be appreciated that other forms of articles, such as bottles having a rim or other flange-like extension, may also be packaged in a similar manner.

Figure 5:
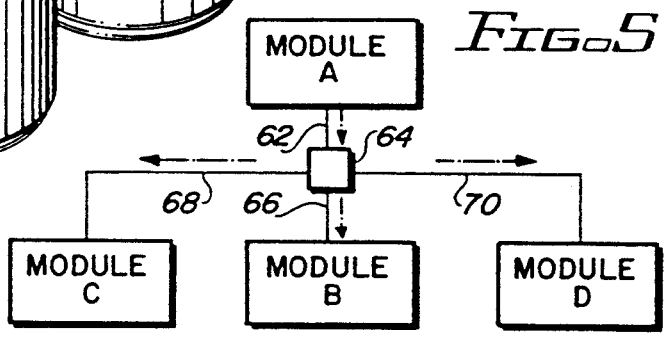
FIG. 5 is a schematic representation of the flow of product in the packaging method of the invention.

The basic carrier unit exits module A by means of a suitable conveyor, indicated diagrammatically at 62 in FIG. 5. The carrier units may be selectively transferred from conveyor 62 to any of several other conveyors which originate at a switching mechanism or junction 64. Thus, they may be transferred to conveyor 66 which leads to module B, or to conveyor 68 which leads to module C, or to conveyor 70 which leads to module D. The different modules incorporate apparatus for fabricating a variety of different final package designs, so that the basic unit exiting from module A would be diverted to whichever other module will produce the desired final form of the package.

Figure 7:
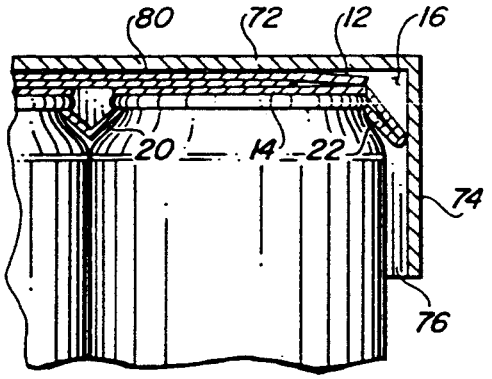
FIG. 7 is an enlarged partial transverse sectional view taken along line 7—7 of FIG. 6.

Module B is designed to provide an outer carrier wrap around the support body of the basic unit. As shown in FIG. 6, one type of package that can result comprises a top panel 72 having depending partial side panels 74 and end panels 76. The top panel includes finger holes 78 which overlie the finger holes of a carrier such as support body 10 to enable a user to grasp the carrier handle through the outer wrap. If the top panel is applied to a carrier such as support body 10', the finger holes 78 simply overlie the groove formed by the ribs 20', which provides space for a user's fingers which have been inserted into the finger holes. As shown in FIG. 7, the top panel 72 of the outer wrap is connected to the panel 12 of the carrier 10 by adhesive 80. Of course, if a carrier unit is employed which does not have a top panel, such as in the case of carrier 10', the outer wrap would be connected directly to the single panel 14' of such a unit. Although gluing is preferred, it will be understood that other types of connecting means, such as mechanical locks, could be utilized instead if desired. The partial side and end panels, as well as the top panel, provide additional so-called package "billboard" space for printed indicia, and the outer wrap transforms the appearance of the carrier unit by giving it a finished or quality look. The outer wrap snugly fits over the support body of the basic carrier unit and provides additional stability or rigidity as a result of the side panels and end panels being connected together.

Figure 8:
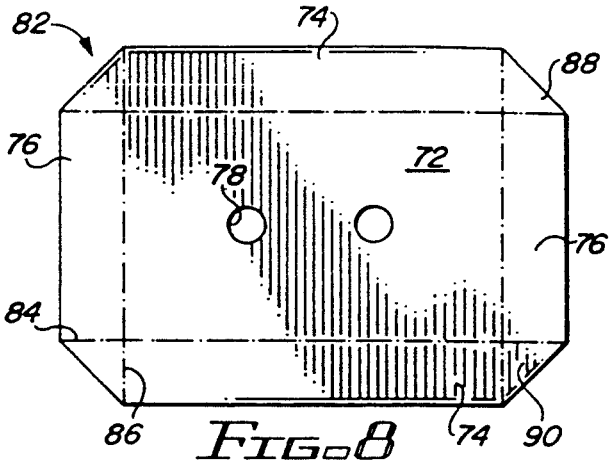
FIG. 8 is a plan view of a blank which can be used to form the outer wrap employed in the carrier of FIG. 6.
Figure 9:
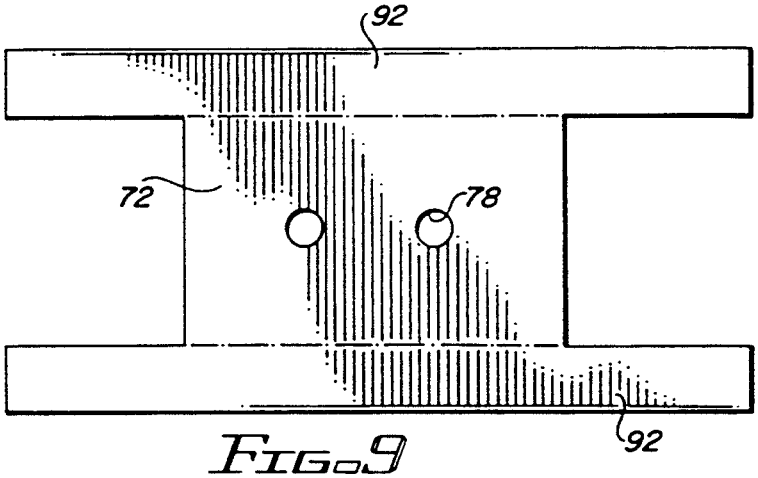
FIG. 9 is a plan view of another blank which can be used to form the outer wrap employed in the carrier of FIG. 6.

The outer wrap may be formed in any desired manner. For example, as shown in FIG. 8, the outer wrap of FIG. 6 may be formed from the blank 82, which includes sections corresponding to the top panel 72, the side panels 74 and the end panels 76. The side panels and end panels are connected along fold lines 84 and 86 to triangular shaped gussets or tuck flaps 88, which include a center fold line 90. Instead of tuck flaps, glue flaps could be provided to connect the side panels to the end panels. A blank such as that shown in FIG. 9 could also be used, wherein two elongated side panel flaps 92 are provided. The end panels in this arrangement are formed by folding the extending side panel flaps along the edge of the top panel to the next side panel flap and gluing the ends of the flaps to the next side panel flap to produce an outer wrap of the same appearance as that of FIG. 6. The lengths of the elongated side panel flaps may be varied, which would vary the location at which they are glued together.

Figure 10:
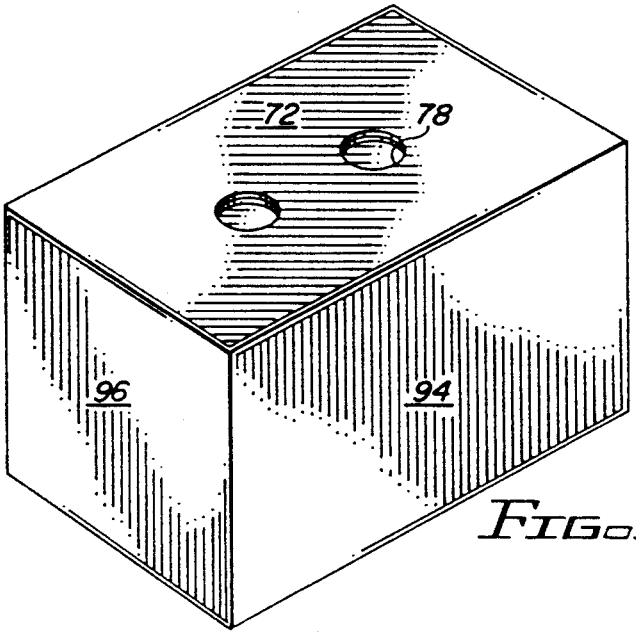
FIG. 10 is a pictorial view similar to that of FIG. 6, but showing a modified carrier.

Other variations of outer wraps may be formed in module B. Instead of providing an outer wrap with only partial side and end panels, full panels may be provided. This is illustrated in FIG. 10, wherein side panels 94 and end panels 96 extend down to the bottom of the articles supported by the support body. The package may be open at the bottom, as in the case of the carrier of FIG. 6, or it can have a bottom panel connected to the side and/or end panels, which provides greater rigidity. By having full panels the articles are completely covered, which is beneficial in the packaging of some products. If the bottom is open, the side and end panels can extend down only to the bottom of the supported articles in order to allow the articles to rest on a support surface. This is also the preferred arrangement for an outer wrap having a bottom panel. In view of the simplicity of the outer wrap design, it is not necessary to illustrate the blank used to fabricate the wrap of this modification or other modifications described hereinafter.

Another form of outer wrap is shown in FIG. wherein the side panels 94 are of full height, while the end panels 98 are of only partial height and are located at the bottom of the package. This provides for added rigidity over the partial panels of FIG. 6 but uses less paperboard or other material than the full enclosure of FIG. 10. By locating partial end panels at the bottom of the package the UPC code on the lower portion of the articles is hidden, thereby avoiding confusion that could result from the UPC code appearing on both the package and the individual articles. As in the case of the full paneled package of FIG. 10, a bottom panel may be provided if desired.

Figure 12:
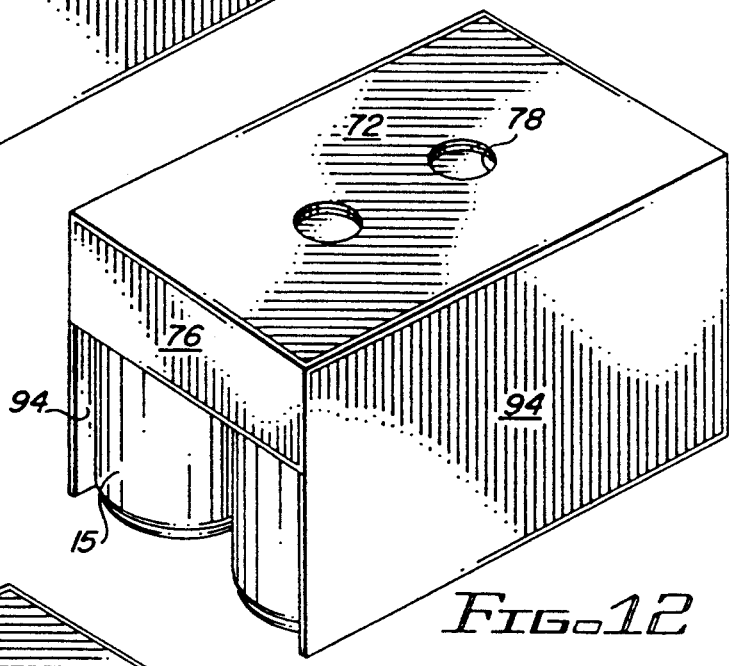
FIG. 12 is a pictorial view similar to that of FIG. 6, but showing a further modified carrier.

Another variation of the packages described is shown in FIG. 12, where full side panels 94 are provided and the partial end panel 76 is located at the top of the package. This would be utilized primarily where it is desired to conceal the UPC codes in countries where they are located on the upper portion of the articles.

The mechanism for placing the outer wrap blanks on top of the basic carrier unit and folding and gluing the blank to form the outer wrap has not been illustrated, inasmuch as it is well within the knowledge of one skilled in the packaging art.

Figure 13:
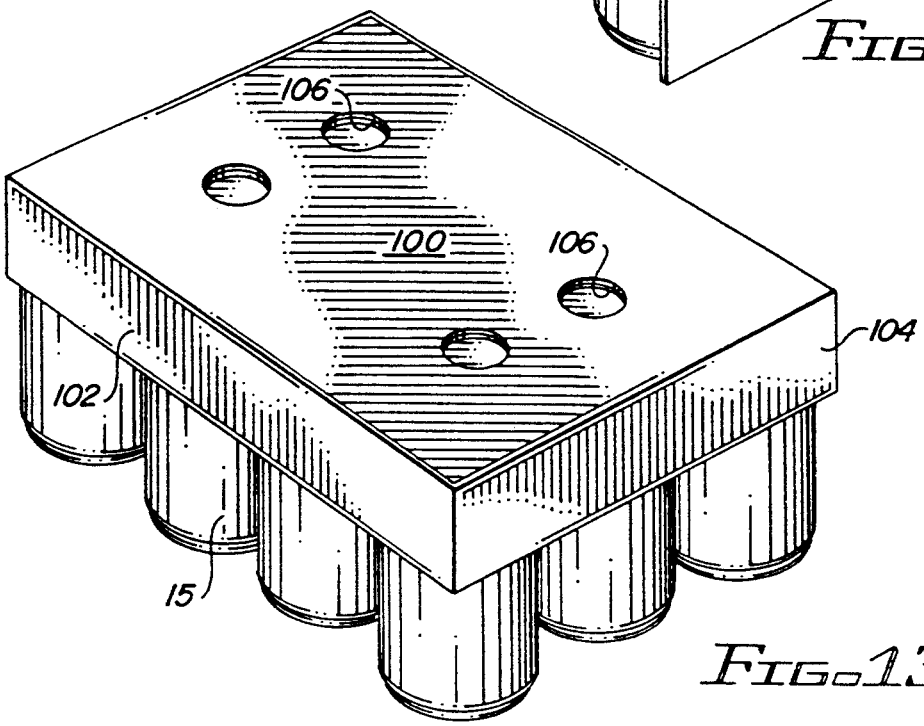
FIG. 13 is a pictorial view of a carrier comprised of two carrier units of the types shown in FIGS. 1 or 3.

Referring back to FIG. 5, an alternative to forming a wrapper around a single clip-type carrier as is done in module B, is to divert the basic carrier units exiting from module A to module C, where two or more carrier units are juxtapositioned and an outer wrap is formed around the adjacent units. Such an arrangement is shown in FIG. 13, wherein the outer wrap consists of a top panel 100 and partial side and end panels 102 and 104, respectively. The top panel is provided with openings 106 aligned with the finger holes of an underlying carrier, such as support body 10, or with the groove formed by the ribs of a carrier such as support body 10'. This arrangement permits a user to pick up the package by grasping only one set of finger holes. The package would be carried substantially vertically when lifted in this manner, but the rigidity of the package, due in large part to the adhesive bonding the top panel to the underlying support body, makes this a viable lifting and carrying procedure.

Figure 11:
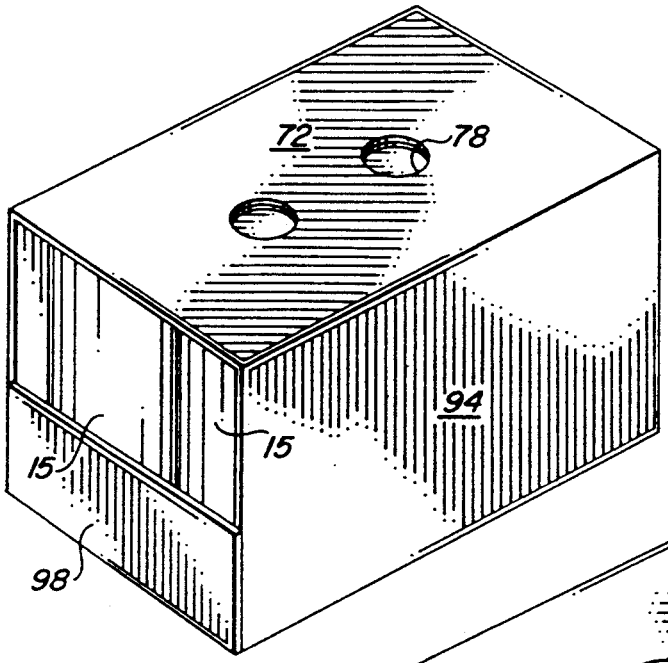
FIG. 11 is a pictorial view similar to that of FIG. 6, but showing another modified carrier.
Figure 14:
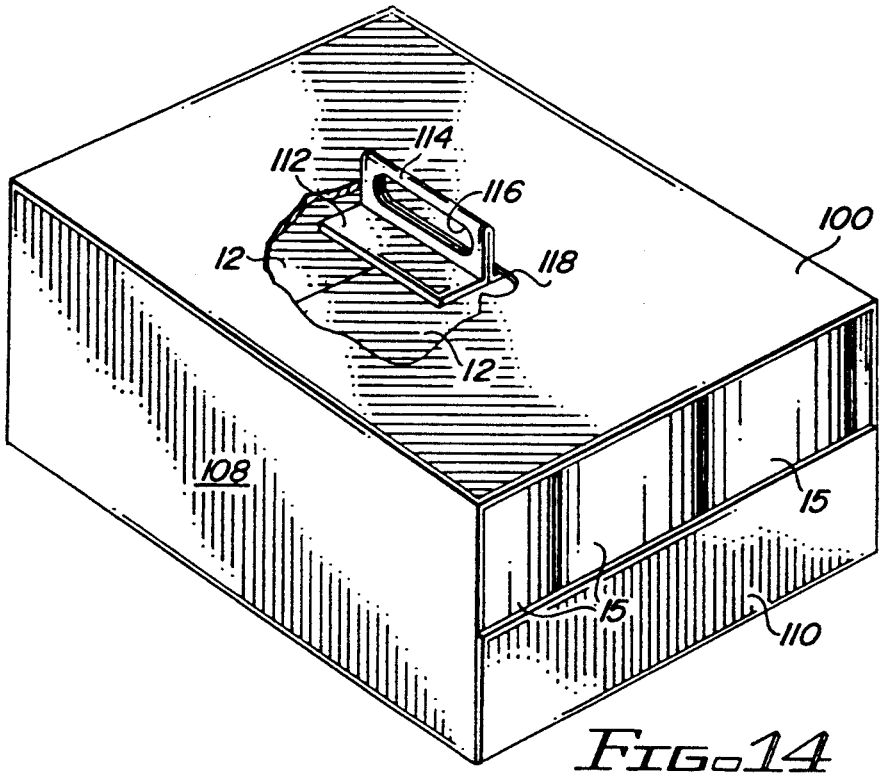
FIG. 14 is a pictorial view similar to that of FIG. 13, but showing a modified carrier.

A variation of the multi-unit package produced in module C is illustrated in FIG. 14, which incorporates full side panels 108 and partial end panels 110 similar to the outer wrap arrangement of FIG. 11. As in the case of the single unit packages utilizing full side panels, a bottom panel may also be provided if desired. A different handle design is illustrated wherein a separate handle element 112 is glued to the top panels 12 of the support clips, or to the main bodies 16' of carrier units which do not have top panels, across the juncture between the adjacent carrier units. The handle element includes an upright handle 114 containing an opening 116. The outer wrap 100 contains an opening 118 through which the handle 114 extends. This handle, which is not limited to this particular package but may be used with any multi-unit package design, enables the package to be readily lifted and carried by one hand while remaining substantially horizontal.

Figure 15:
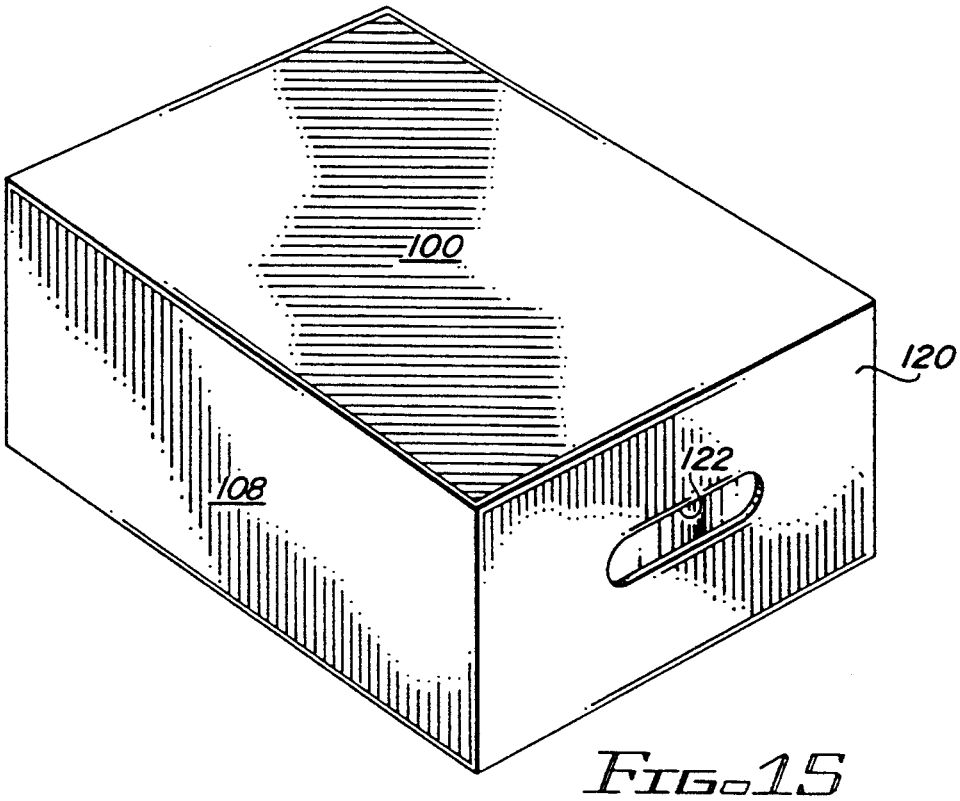
FIG. 15 is a pictorial view similar to that of FIG. 13, but showing another modified carrier.

A further multi-unit package modification is illustrated in FIG. 15, wherein full side and end panels 108 and 120 are provided and handle openings 122 are incorporated in the end panels 120. Even though the outer wrap may be of less thickness than the paperboard used to form the carrier unit clips, the fact that the lifting and carrying stresses are primarily parallel to the end panel allows a handle opening in the outer wrap to perform well. As in the other designs, a bottom panel may be provided if desired.

Figure 16:
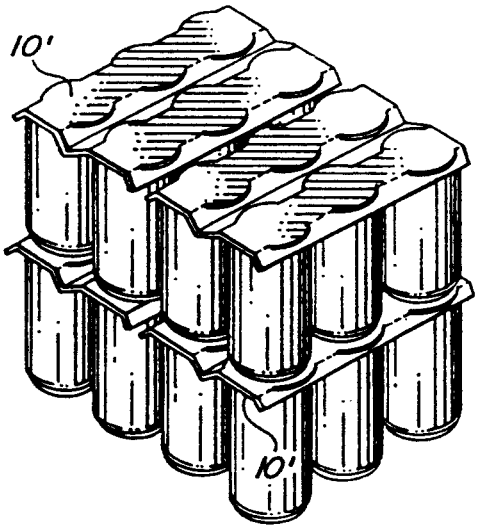
FIG. 16 is a pictorial view of a plurality of stacked carrier units prior to being provided with an outer wrap.
Figure 17:
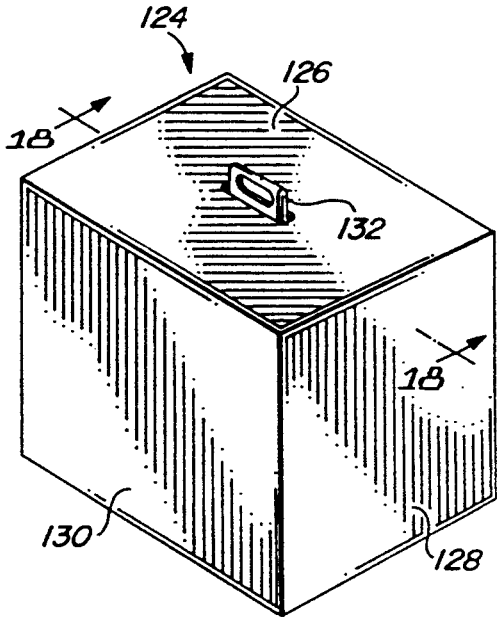
FIG. 17 is a pictorial view of a carrier comprised of the stacked units of FIG. 16.
Figure 18:
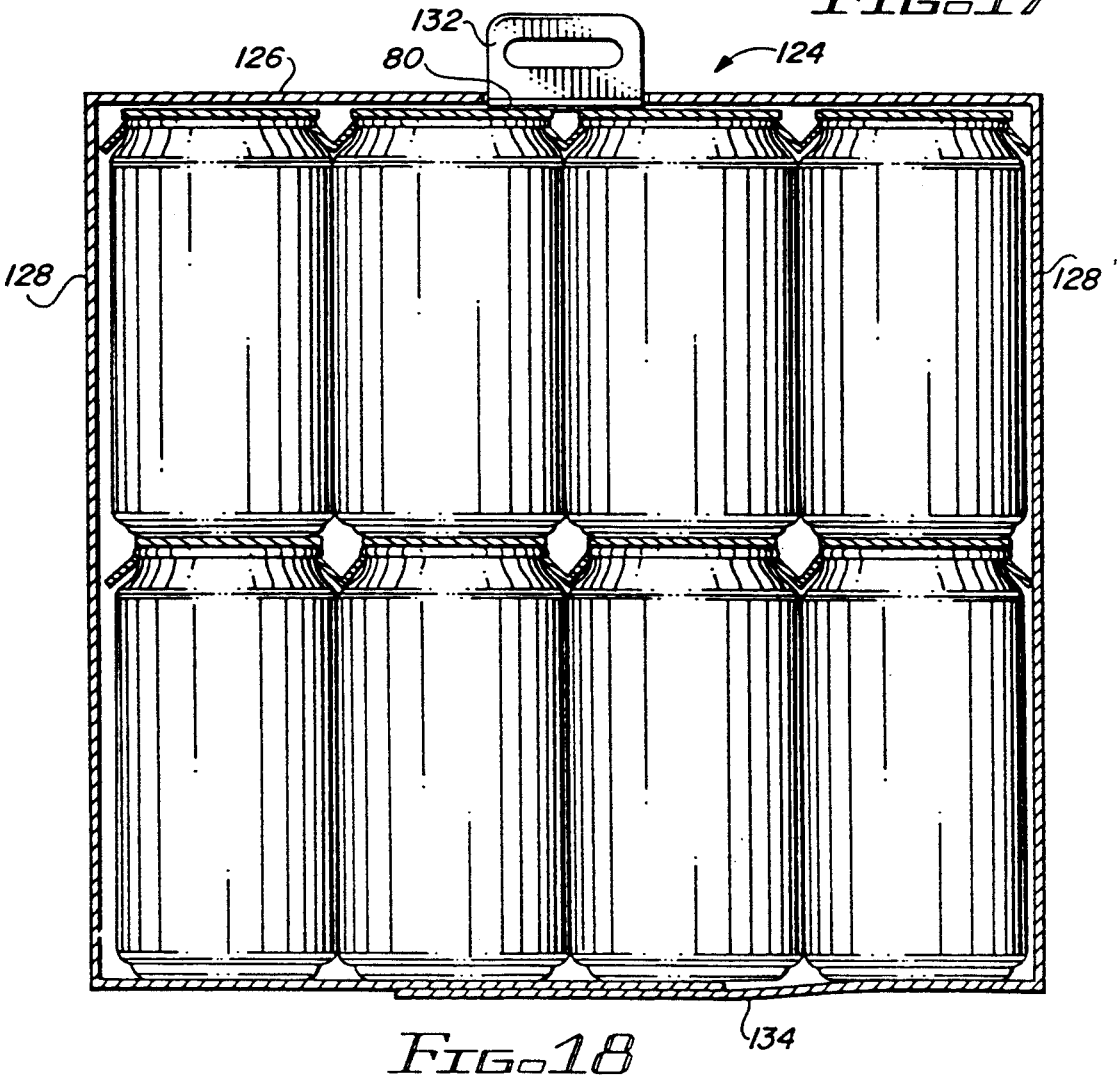
FIG. 18 is a transverse sectional view taken on line 18—18 of FIG. 17.

Another alternative package design may be fabricated in module D, where a package incorporating stacked carrier units 10' is produced. It will be understood that although either type of carrier unit 10 or 10' can be utilized in this embodiment, carrier units 10' are illustrated merely for the sake of clarity. Referring to FIG. 16, the carrier units 10' are first stacked in two layers consisting of two units each, with one dimension of the stack corresponding to the longer side of a carrier unit and the other dimension corresponding to two shorter sides of a carrier unit. As illustrated in FIG. 17, an outer wrap is then folded about the layers to form a package 124 having a top panel 126, side panels 128 and end panels 130. A handle 132 may be provided, such as a handle similar to the handle in the package of FIG. 14. As illustrated in FIG. 18, a bottom panel 134 is provided which is unattached to the adjacent carrier units. With the carrier units in the bottom layer unattached to the outer wrap and to each other, when the package is lifted by the handle the lifting stresses associated with the top layer are generally distributed across the top panel of the outer wrap. This is because the handle is attached directly to the support bodies in the upper layer and thus transfers lifting stresses directly to the upper layer support bodies, which in turn transfer lifting stresses to the top panel of the outer wrap. The lower panel of the outer wrap generally supports the weight of the carrier units in the lower layer. This design thus distributes the load generally equally between the top and bottom panels of the outer wrap, enabling relatively thin material to be used as the outer wrap.

It is not necessary to use a handle of the type illustrated. Handle openings in the top or side panels of the outer wrap could be utilized instead. In such a case the carrier units in the upper layer would be bonded to the top panel of the outer wrap by adhesive, which would still effect a substantially equal distribution of lifting stresses between the top and bottom panels of the outer wrap.

As mentioned above, a benefit of the package design of the invention is the ability to use thinner material for much of the carrier. For example, fully enclosed packages made in accordance with the invention may use as much paperboard, as measured by surface area, as a conventional fully enclosed carrier but will require less paperboard stock, resulting in substantial cost savings. Further, since the high quality paperboard required to be used for printing purposes is provided by the relatively thin outer wrap, the amount of expensive paperboard required for a package is greatly reduced. The material cost for packages that are not fully enclosed is reduced even further. The design of the invention permits stock of lesser quality, as related to printing requirements, to be used for the clip-type support body, thereby allowing high strength stock which could not be used for the outer wrap to be used for the support body. Such material may comprise a high percentage of recycled fiber, which could not be used in conventional carriers.

Although the needs of a particular carrier design may vary, the thickness of the outer wrap may readily be up to 50% less than the thickness of conventional carrier wraps. For example, while a conventional carrier may be formed from paperboard having a thickness of 18 mils, a carrier of the present invention may require paperboard having a thickness of only 12 mils.

It should now be clear that the invention provides a number of benefits, including reducing the amount of material needed to form a carrier, allowing recycled stock to be employed in paperboard carriers, reducing packaging machine downtime when changing from one carrier design to another and reducing packaging machinery costs for producing various types of carrier designs. As previously stated, the invention is not limited to use with cans, but may be extended to other types of articles having a rim or other projection capable of being gripped by locking or supporting edges of the clip-type support body of the carrier. The invention is not necessarily limited to all the specific details described in connection with the preferred embodiment, except as they may be within the scope of the appended claims, and changes to certain features of the preferred embodiment which do not alter the overall basic function and concept of the invention are therefore contemplated.

What is claimed is:

1. A method of packaging articles having an outwardly extending flange in an upper portion thereof, comprising:

securing a plurality of articles to an integral support body having a plurality of oppositely facing apertures and adjacent support surfaces so that opposite portions of the flange of each article protrude through associated oppositely facing apertures and are supported on the underside thereof by the adjacent support surface; and attaching an outer paperboard carrier wrap to the article support body, the outer carrier wrap comprising a top panel, opposite side panels and at least one additional panel connecting the opposite side panels, the top panel overlying the article support body and being connected thereto.

2. The method of claim 1, wherein the top panel is connected to the article support body by adhesive.

3. The method of claim 1, wherein the material forming the carrier wrap is thinner than the material forming the support body.

4. The method of claim 1, wherein the article support body and the articles supported thereby form a carrier unit, the method including the step of forming a plurality of carrier units, positioning the units adjacent each other, and attaching the outer carrier wrap so that the top panel of the outer carrier wrap overlies the adjacent carrier units.

5. The method of claim 4, wherein the carrier units are arranged in at least two stacked layers with at least two carrier units in each layer.

6. A method of packaging articles having an outwardly extending flange in an upper portion thereof, comprising:

continuously moving segregated groups of articles containing a predetermined number of articles to a first packaging station;

securing the articles of each group to an integral support body at said first packaging station to form a carrier unit, the support body including a plurality of oppositely facing apertures and adjacent support surfaces, the articles being secured to the support body so that opposite portions of the flange of each article protrude through associated oppositely facing apertures and are supported on the underside thereof by the adjacent support surface;

continuously moving a stream of carrier units selectively to one of a plurality of further packaging stations;

attaching an outer paperboard carrier wrap to the article support body of the carrier units at said one further packaging station whereby the outer carrier wrap comprises a top panel overlying and connected to the article support body, opposite side panels and at least one additional panel connecting the opposite side panels; and diverting the continuously moving stream of carrier units away from said one further packaging station to another of said further packaging stations and attaching a different design of outer paperboard carrier wrap to the article support body of the carrier units to produce a different design of carrier than the carriers produced at said one further packaging station.

7. The method of claim 6, wherein an outer carrier wrap is attached to the article support body of a single carrier unit at said one further packaging station.

8. The method of claim 6, wherein an outer carrier wrap is attached to the article support bodies of a plurality of adjacent carrier units at said one further packaging station.

9. The method of claim 6, wherein an outer carrier wrap is attached to the article support bodies of a plurality of adjacent carrier units in the upper layer of a stacked arrangement of carrier units at said one further packaging station.

10. The method of claim 6, wherein the outer carrier wrap is comprised of thinner material than the material comprising the article support body.

* * * * *